United States Patent [19]

Mollon et al.

[11] 3,970,001

[45] July 20, 1976

[54] LOCK-UP FOR THIN PRINTING PLATE

[75] Inventors: Leslie Mollon, Southfield; John E. Kline, Farmington, both of Mich.

[73] Assignee: Brooks & Perkins, Incorporated, Southfield, Mich.

[22] Filed: Oct. 26, 1972

[21] Appl. No.: 300,903

[52] U.S. Cl. ..... 101/415.1; 101/378; 292/256.69; 292/DIG. 29

[51] Int. Cl.[2] ..... B41F 27/06

[58] Field of Search ..... 101/415.1, 378; 292/256.69, DIG. 29

[56] References Cited

UNITED STATES PATENTS

| | | | |
|---|---|---|---|
| 427,320 | 5/1890 | Hawkins | 101/415.1 |
| 495,466 | 4/1893 | Jones | 101/415.1 |
| 597,952 | 1/1898 | Burnham | 101/415.1 |
| 1,640,347 | 8/1927 | Chisholm | 101/415.1 |
| 1,980,386 | 11/1934 | Davis | 101/415.1 |
| 2,388,193 | 10/1945 | Stempel | 101/415.1 |
| 2,915,010 | 12/1959 | Crafts | 101/378 |
| 3,217,644 | 11/1965 | Schmidt | 101/415.1 |

FOREIGN PATENTS OR APPLICATIONS

| | | | |
|---|---|---|---|
| 910,712 | 11/1962 | United Kingdom | 101/415.1 |

*Primary Examiner*—Clyde I. Coughenour
*Attorney, Agent, or Firm*—Whittemore, Hulbert & Belknap

[57] ABSTRACT

Lock-up structure for applying a thin flexible press roll to a generally semi-cylindrical saddle comprising means for fixing one end of a printing plate to one straight edge of the saddle, and a bar at the other straight edge of the saddle. The bar includes means for affixing the opposite edge of the printing plate thereto. Toggle means are provided for swinging the bar into position adjacent the other straight edge of the saddle while applying a predetermined tension to the printing plate.

3 Claims, 9 Drawing Figures

LOCK-UP FOR THIN PRINTING PLATE

BRIEF DESCRIPTION OF THE INVENTION

Relatively thin flexible printing plates are coming into wide-spread use in the printing industry. Such plates may be formed of metal such for example as zinc or magnesium, or they may be formed of a suitable plastic material. Problems are presented in attaching these thin flexible printing plates to the press roll of the printing press.

In accordance with the present invention the thin flexible printing plate is attached to a generally semi-cylindrical saddle which in turn is affixed to the printing plate by known mechanism.

It is a requirement that the printing plate be applied to the saddle under predetermined tension. For example, it is considered desirable at present to apply thin flexible metal printing plates with a tension of about 100 lbs. between the ends of the plate which are secured to the saddle. It appears that plastic printing plates should be applied under a similar tension of approximately 300 lbs.

In accordance with the present invention, the generally semi-cylindrical saddle is provided at one straight edge thereof with means for receiving one edge of the flexible printing plate. In the case of a metal printing plate this means may be constituted by a reversely inclined groove into which one edge of the printing plate is inserted. In the case of a plastic printing plate the corresponding edge of the saddle may be provided with a groove having a reversely inclined side wall terminating in a sharp edge to receive a thickened bead provided on the corresponding edge of the printing plate.

At the opposite straight edge of the printing plate there is provided a bar having means thereon for fixedly receiving the opposite edge of the thin flexible printing plate. This means for attaching the opposite edge of the printing plate may be identical to that provided at the opposite edge of the saddle.

Toggle mechanism is provided for attaching the bar to the opposite edge of the saddle in such a way that the bar is swung laterally outwardly from the saddle away from the press roll about an arc which shortens the distance between the bar and the opposite edge of the saddle. Upon swinging the bar in a reverse direction into engagement with the press roll and in immediate juxtaposition to the adjacent edge of the saddle, the printing plate is tensioned and is drawn into smooth contact under tension against the smooth cylindrical outer surface of the saddle.

Preferably, the toggle mechanism attaching the bar adjacent one edge of the saddle is formed by providing a plurality of circumferentially extending slots in the edge portion of the saddle, and providing arms extending laterally from the bar into the slots. Pivot means are provided between the free ends of the arms and the saddle adjacent the inner ends of the slots.

DETAILED DESCRIPTION

Figure 1:
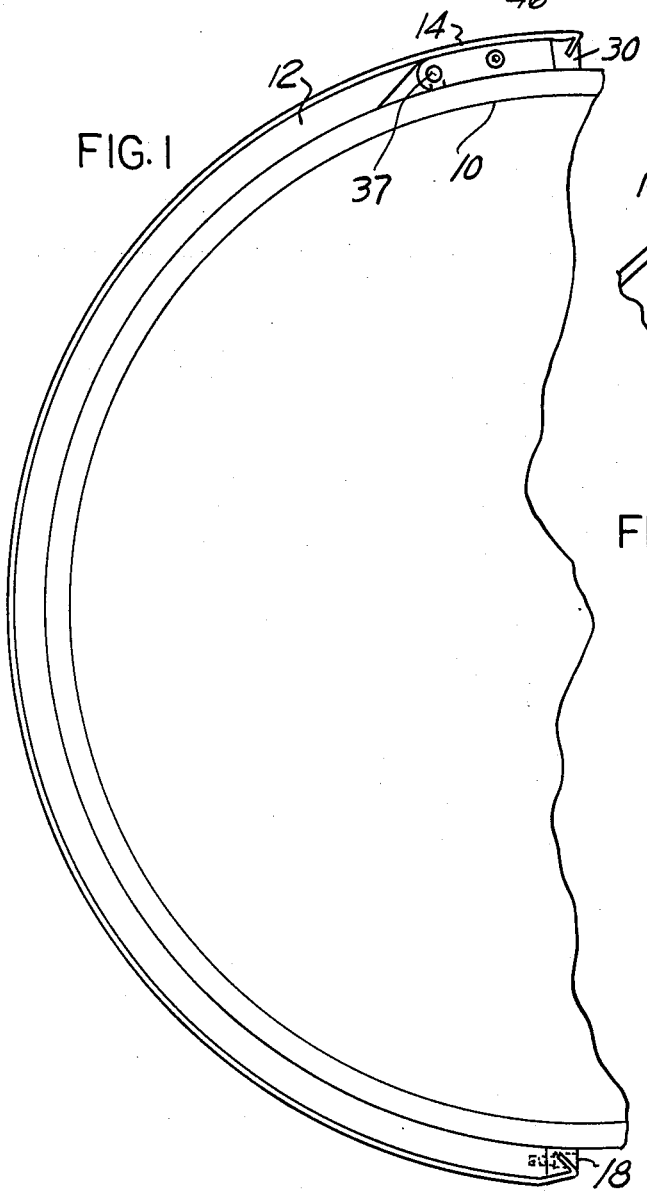
FIG. 1 is a fragmentary end view of the lock-up structure associated with a press roll.

Referring first to FIG. 1, there is illustrated a portion of a cylindrical press roll 10 and the generally semi-cylindrical saddle 12 to which a thin flexible printing plate 14 is secured. The saddle is attached to the press roll by known means such for example as clamping means acting between peripheral end portions 16 of the press roll and the curved edges of the saddle.

Figure 4:
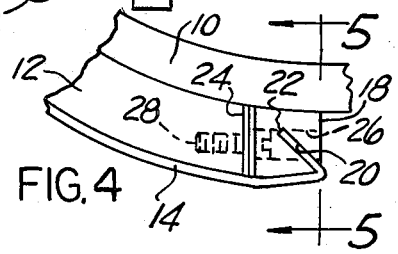
FIG. 4 is a fragmentary elevational view showing attachment of a bar to the opposite end of the saddle.
Figure 5:
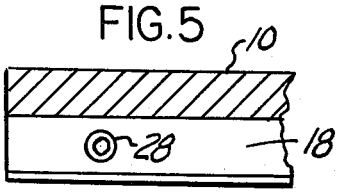
FIG. 5 is a fragmentary view on the line 5—5, FIG. 4.

Attached to one straight edge of the saddle is a printing plate supporting bar 18, details of which are best illustrated in FIGS. 4 and 5. The bar is provided with a reversely inclined groove 20 adapted to receive an oppositely bent edge portion 22 of a thin flexible printing plate 14. In this case the printing plate 14 is assumed to be a metallic plate and the reversely bent portion 22 thereof, when pressed into the inclined groove 20, constitutes an adequate support for the plate.

In order to adjust for variations in size of printing plate and to apply a predetermined tension to the plate as it is tensioned around the outer cylindrical surface of the saddle, means are provided for receiving shims such as illustrated at 24 interposed between the edge portion of the saddle 12 and the adjacent surface of the bar 18. The bar is provided with openings 26 which receive attaching screws 28, the screws passing through suitable openings in the shim or shims 24.

While ordinarily it is desired to lock up the flexible printing plate rigidly without provision for circumferential movement, it is within the scope of the present invention to provide yieldable or resilient elements in place of the usually metallic incompressible shims 24.

Figure 3:
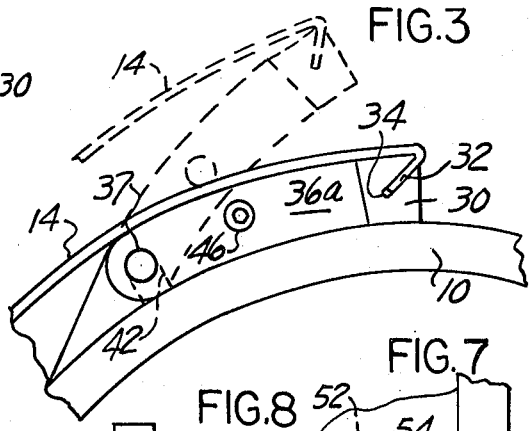
FIG. 3 is an enlarged view illustrating the toggle connection of the movable support bar.

At the opposite straight edge of the saddle 12 there is provided a movable plate supporting bar 30 which as best seen in FIG. 3, is provided with means for fixedly engaging the edge of the printing plate 14 opposite to the edge engaged by the bar 18. For this purpose the bar 30 is provided with a reversely inclined groove 32 receiving the reversely bent end portion 34 of the printing plate 14.

Figure 2:
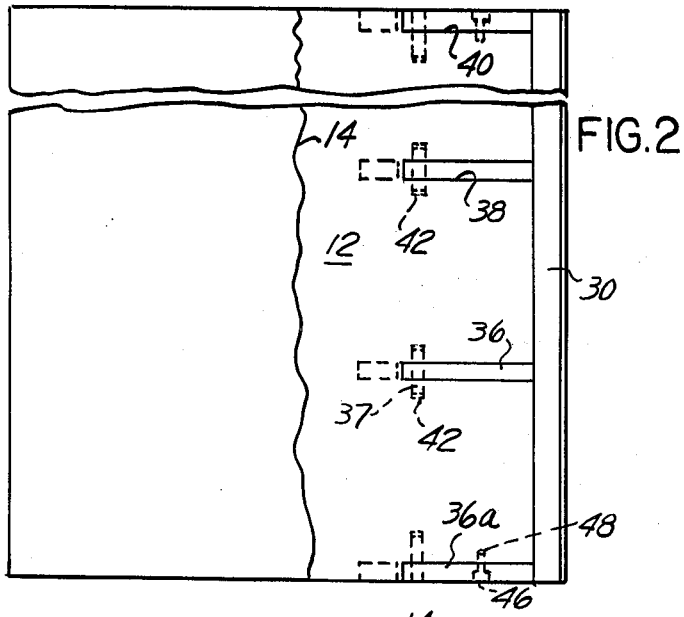
FIG. 2 is a fragmentary plan view of the structure shown in FIG. 1.
Figure 6:
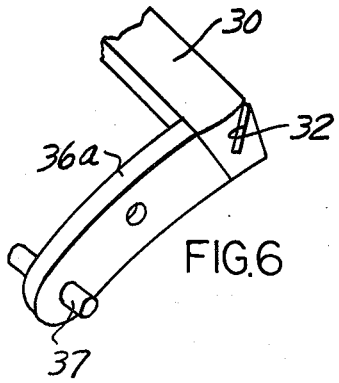
FIG. 6 is an enlarged perspective view of a portion of a movable bar and the support arm therefor.

In order to provide the required tension in the printing plate, the bar 30 is pivotally supported to the saddle by means which constitute a toggle connection. This means comprises a multiplicity of arms 36 fixedly secured to the bar 30 and having at their free ends pivot pins 37 by means of which the arms are pivoted to the saddle adjacent an edge thereof. As illustrated in FIG. 2, there are a plurality of intermediate arms 36 and the ends of the bar 30 are connected to identical arms **36*a*. The intermediate arms 36 are received in slots 38 formed to extend circumferentially inwardly from the adjacent edge of the saddle 12. The end arms 36*a* are associated with inwardly formed recesses 40** provided at opposite sides of the saddle.

The means for establishing the pivot connection between the bar 30 and the saddle comprises transverse slots 42 intersecting the slots 38 and recesses 40, and extending radially outwardly from the inner surface of the saddle as clearly illustrated in FIG. 3. The pins 37 extend laterally in opposite directions from the intermediate arms 36 and extend inwardly from the end arms 36*a*. These pins may be freely introduced into the slots 42 while the arms 36 and 36*a* occupy the slots 38 and recesses 40, while the arms occupy the dotted line position best illustrated in FIG. 3. At this time the saddle may be applied to the press roll 10, thus closing the inner ends of the slots 42 and retaining the arms 36 and 36*a* in assembled position.

It will be observed from FIG. 3 that the inner ends of the arms 36 and 36*a* are cylindrical and have a radius such that the curved peripheral surface of the free ends of the arms 36 and 36*a* remain in contact with the outer surface of the press roll 10 as the arms are swung between the full line and dotted line positions illustrated in FIG. 3.

Suitable means are provided to insure that when the movable bar 30 has been moved into the full line position of FIG. 3, at which time the printing plate 14 is subjected to the required amount of tension, the bar 30 is locked in position during subsequent printing operation. For this purpose the outer arms 36*a* may carry pointed set screws 46, the inner ends of which may extend into recesses 48 formed in the sides of the saddle 12.

Figure 7:
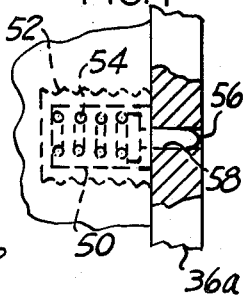
FIG. 7 is a fragmentary view, partly in section, showing locking means acting between the saddle and a support arm.
Figure 9:
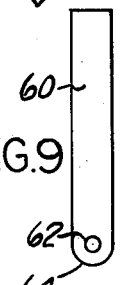
FIGS. 8 and 9 are elevational views of tools used to release the locking pins shown in FIG. 7.
Figure 8:
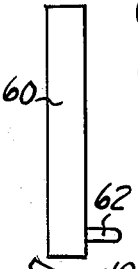

Preferably however, the mechanism best illustrated in FIGS. 7, 8 and 9 is provided for locking and unlocking the bar 30 in operating position. For this purpose the saddle 12 is provided adjacent its opposite edges and in approximately the same position as indicated by the recesses 48 in FIG. 2, with the threaded recesses 50 adapted to receive externally threaded capsules 52 having spring means 54 therein normally urging locking pins 56 outwardly into openings 58 extending through the arms 36*a*. Thus, when the pins 56 are pressed inwardly and the bar 30 is swung downwardly with a toggle action movement into engagement with the outer surface of the press roll, the pins are urged by the springs 54 into the openings 58 and hence, lock the bar 30 in operating position.

In order to release the bar 30, the tools best illustrated in FIGS. 8 and 9 are provided. These tools comprise handles 60 having pins 62 at one end thereof shaped to enter the openings 58 through the arms 36*a* and to press the spring pressed pins 56 out of the openings 58. For this purpose the pins 62 have a length substantially equal to the width of the arms 36*a* so that when the pins 62 are fully inserted into the openings 58, the locking pins 56 are moved completely out of the openings 58.

In order to facilitate finding the openings 58 with the tool releasing pins 62, the ends of the tools are curved as indicated at 64 to a radius such that when the tool is engaged against the outer surface of the press roll the pins 62 are in alignment with the openings 58 and may find the openings 58 by movement along the outer surface of the press roll. It will be understood that the tools are provided in pairs since the operator is required to effect simultaneous release of the spring pressed locking pins 56 to free the bar 30 for movement away from the press roll 30.

While reference in the foregoing description of a preferred embodiment of the invention is made to generally semi-cylindrical saddles, it will be understood that the invention may encompass saddles of any desired circumferential angular extent.

What we claim as our invention is:

1. Printing plate lock-up structure comprising a generally partly cylindrical saddle having opposite arcuate side edges and straight end edges and adapted to be fixed to a cylindrical press roll, means at one straight edge of said saddle for fixed engagement with one edge of a thin flexible printing plate, a movable bar adjacent the opposite straight edge of said saddle, means on said bar for fixedly engaging the opposite edge of said plate, toggle means connecting said bar to said saddle to tension the printing plate as said toggle means is straightened, said toggle means comprising arms extending laterally from the ends of said bar and pivoted to the sides of said saddle at the outer ends of said arms, locking means acting between said arms and said saddle for locking said arms to said saddle with said bar in position adjacent the said opposite free edge of said saddle and against said press rolls, said locking means comprising outwardly biased spring pressed pins in the sides of said saddle, and openings in said arms adapted to receive the ends of said pins when said bar is in position against said press roll.

2. Structure as defined in claim 1 comprising a pair of releasing tools for simultaneously pressing both of said pins inwardly to a position of clearance with respect to the openings in said arms, said tools having laterally projecting pins at the ends thereof dimensioned to enter said openings, said last mentioned pins having a length substantially equal to the transverse dimension of said arms.

3. Structure as defined in claim 2, the ends of said tool provided with said last mentioned pins being curved on a radius approximately equal to the spacing of the openings in said arms from the edge thereof adjacent the press roll.

* * * * *